US005482391A

United States Patent [19]

Cook

[11] Patent Number: 5,482,391

[45] Date of Patent: Jan. 9, 1996

[54] TICKET ISSUING DEVICE

[75] Inventor: John C. Cook, Roodepoort, South Africa

[73] Assignee: The Republic of South Africa, South Africa

[21] Appl. No.: 219,903

[22] Filed: Mar. 30, 1994

Related U.S. Application Data

[63] Continuation of Ser. No. 993,709, Dec. 21, 1992, abandoned.

[30] Foreign Application Priority Data

Dec. 19, 1991 [ZA] South Africa ..... 91/9989

[51] Int. Cl.[6] ..... B41J 29/00; B41L 45/00

[52] U.S. Cl. ..... 400/691; 400/708; 101/66

[58] Field of Search ..... 101/66, 67, 68, 101/69; 400/605, 691, 692, 693, 703, 708; 235/384

[56] References Cited

U.S. PATENT DOCUMENTS

| | | | |
|---|---|---|---|
| 3,255,692 | 6/1966 | Hohmann | 101/66 |
| 4,381,705 | 5/1983 | Roes et al. | 101/66 |
| 4,704,518 | 11/1987 | Brunn et al. | 400/625 |
| 4,812,060 | 3/1989 | Pailler | 400/605 |
| 5,067,832 | 11/1991 | Baur et al. | 400/692 |

*Primary Examiner*—David A. Wiecking

*Attorney, Agent, or Firm*—Finnegan, Henderson, Farabow, Garrett & Dunner

[57] ABSTRACT

The invention provides a ticket issuing device including ticket roll stock support means, a path for ticket stock to move from the roll past a guillotine station, a magnetic ticket encoder station, a ticket printer station, and computer-controlled ticket processing electronic circuitry, is characterised in that the guillotine, encoder and printer stations comprise separate modules composed of construction elements mounted on base plate members.

12 Claims, 8 Drawing Sheets

TICKET ISSUING DEVICE

This application is a continuation of application Ser. No. 07/993,709, filed Dec. 21, 1992, now abandoned.

FIELD OF INVENTION

This invention relates to a ticket issuing devices.

BACKGROUND OF THE INVENTION

The applicant has invented a ticket issuing device which comprises a plurality of parts and mechanisms as follows:

A roll stock support assembly

A haull-off mechanism for strip material

A rotary-type guillotine

A drive mechanism suitable for a guillotine

A ticket drive mechanism

A print head mounting assembly

A ticket ejector and stacking mechanism

The above parts and mechanisms have the following essential features:

1. The roll stock support assembly comprises a rotatably mounted central hub, the hub being receivable within a central boss of the roll, and a plurality of circumferentially spaced roller elements rotatable about axes disposed substantially at right angles to the axis of rotation of the central hub, the roller elements being adapted to be engaged by a side of the roll in use.

2. The haul-off mechanism for strip material comprises a pair of rollers defining a nip between them whereof at least one roller is driven characterized in that at least one of the rollers is in the form of two roller segments spaced from one another.

3. The rotary-type guillotine comprises a cutting blade and rotatable cutting drum mounted in parallelism with the blade, with the latter biased towards the cutting drum by biasing means, the cutting drum defining a cutting edge which is angled or generally helically disposed relative to the axis of the cutting drum, so that the cutting edge will engage the fixed blade progressively from one end thereof to the other during rotation of the cutting drum, the cutting drum further defining a rebate adjacent the cutting edge so that in a starting position of the cutting drum a slot is defined between the cutting drum and the blade; characterized in the provision of an adjustable stop formation adjacent the cutting blade adapted to act against the biasing means to set the position of the cutting blade relative to the cutting drum.

4. The drive mechanism suitable for a guillotine comprises a drive motor, a cam formation adapted to be driven by the drive motor and a follower driven by the cam formation and which in turn operates the guillotine via a push rod, lever or the like.

5. The ticket drive mechanism for a ticket issuing device comprises means defining a track along which the ticket is to move, endless drive belt means including a drive section extending along the track, pinch members associated with the belt and spaced along the drive section thereof by a distance less than the length of the ticket so that a ticket moving along the track passes between the belt and the pinch members without being free of at least one pinch member, and means to drive the belt for movement of the ticket past magnetic encoder means.

6. The print head mounting assembly comprises a pivotal jaw assembly defining, front and rear beam formations biased towards an open generally V-shaped position, a printing head mounted on the front beam formation and adapted during printing to be disposed generally in contact with a platen roller with the rear beam member rigidly anchored, so that during a printing operation material passing between the printer and the platen roller is acted on by the force of the biasing means.

7. The ticket ejector and stacking mechanism includes a driven roller, a pinch member adjacent to the driven roller and together with the latter providing a throat into which tickets emanating from the ticket issuing device pass whereby tickets are pinched between the driven roller and the pinch member and are ejected from the throat through the drive action of the driven roller, swing arm means located above the driven roller and spring biased to a position at rest in which it extends across the throat in a direction inclined to the direction of movement of a ticket through the throat so that a ticket, in passing through the throat engages the swing arm and is deflected to a position clear of a succeeding ticket passing through the throat, and a tray for collecting deflected tickets in a stack.

OBJECT OF INVENTION

It is an object of the present invention to provide a ticket issuing sequence and device for purposes of combining and utilizing the features above.

SUMMARY OF INVENTION

According to the invention a ticket issuing device of the kind including ticket roll stock support means, a path for ticket stock to move from the roll past a guillotine station, a magnetic ticket encoder station, a ticket printer station, and computer-controlled ticket processing electronic circuitry, is characterized in that the guillotine, encoder and printer stations comprise separate modules composed of construction elements mounted on base plate members.

Also according to the invention the guillotine module incorporates guillotine means, and roll stock haul-off means including a guide roller and pinch drive roller, and motors for operation of the guillotine and the drive roller.

The magnetic ticket encoder module includes magnetic encoder means, belt ticket drive means incorporating a motor for operation thereof and for movement of a ticket along a primary track past the encoder means, and sensor means linked to the electronic circuit for control of the ticket processing operation by transmission of ticket processing signals to the said computer.

Such sensor means may comprise a series of sensors spaced along the primary track for detecting the position of a ticket during its movement along the track, the sensors transmitting ticket processing signals in accordance with a sequence based on the position of the ticket.

The magnetic ticket encoder module may further define a secondary track, linked to the primary track, for receipt of an external ticket to be moved into the primary track, the encoder module including drive means for movement of such external ticket along the secondary track and a sensor for detecting the location of an external ticket in the secondary track and for transmitting an external ticket processing signal.

Further according to the invention the printer module incorporates printer and drive platen roller means, support members for a print ribbon cassette for the printer, ticket ejector roller means, and a motor for each of the drive platen and ticket ejector rollers.

Still further according to the invention the ticket processing sequence includes the step of movement of the ticket roll stock web by the haul-off means in the guillotine module to advance the web to a first sensor in the encoder module, such first sensor detecting the leading edge of the web and acting to halt movement of the web with its leading edge adjacent the trailing edge of the belt ticket drive means.

The subsequent step in the sequence includes operation of the guillotine to sever the web and provide a separate ticket on receipt of a ticket demand signal from the computer, the operation of the guillotine being followed by commencement of the belt ticket drive means.

DETAILED DESCRIPTION OF INVENTION

Further aspects of the ticket printing sequence and of the invention are described below with reference to the drawings wherein.

Figure 1:
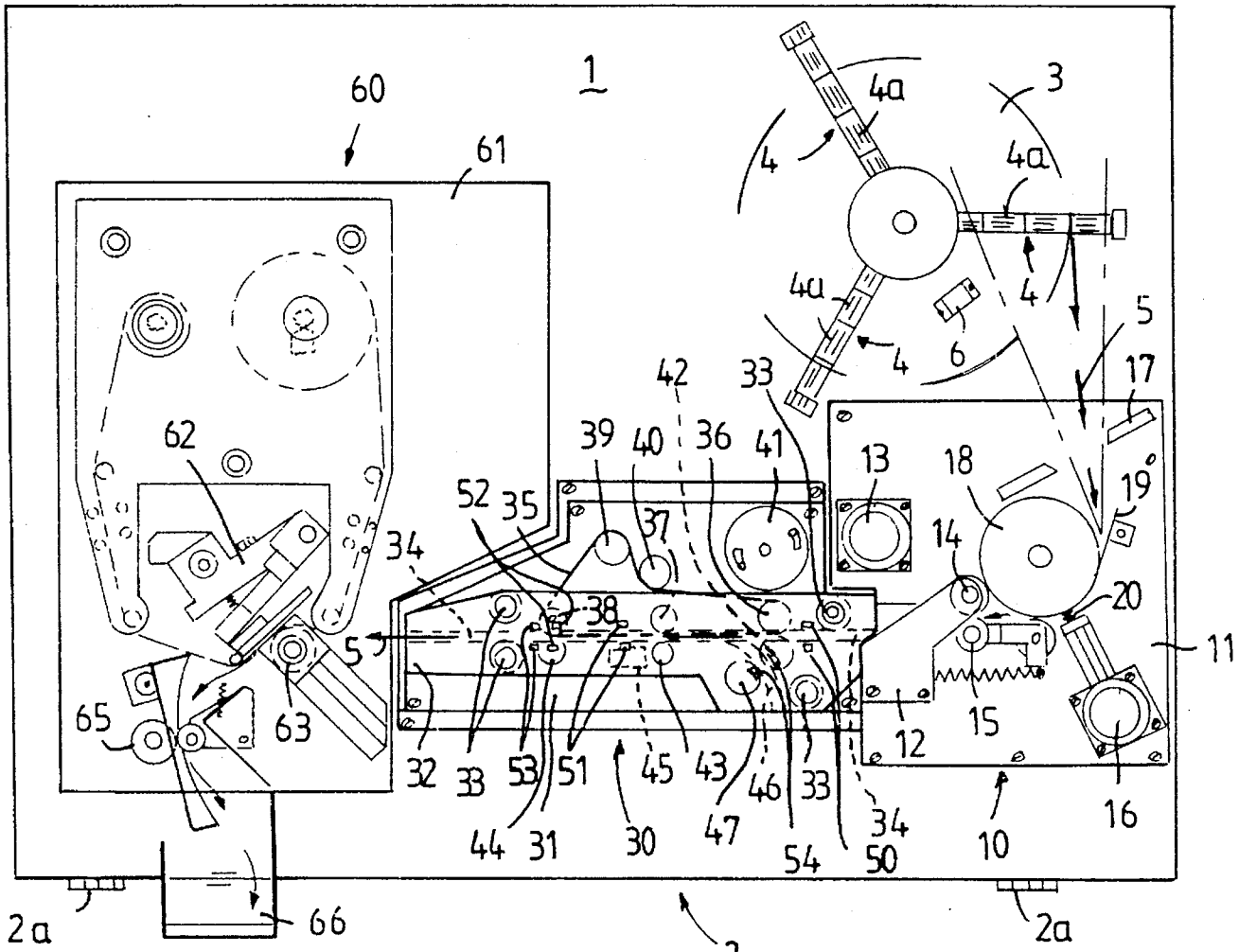
FIG. 1 is a diagrammatic layout of a ticket issuing device according to the invention.
Figure 2:
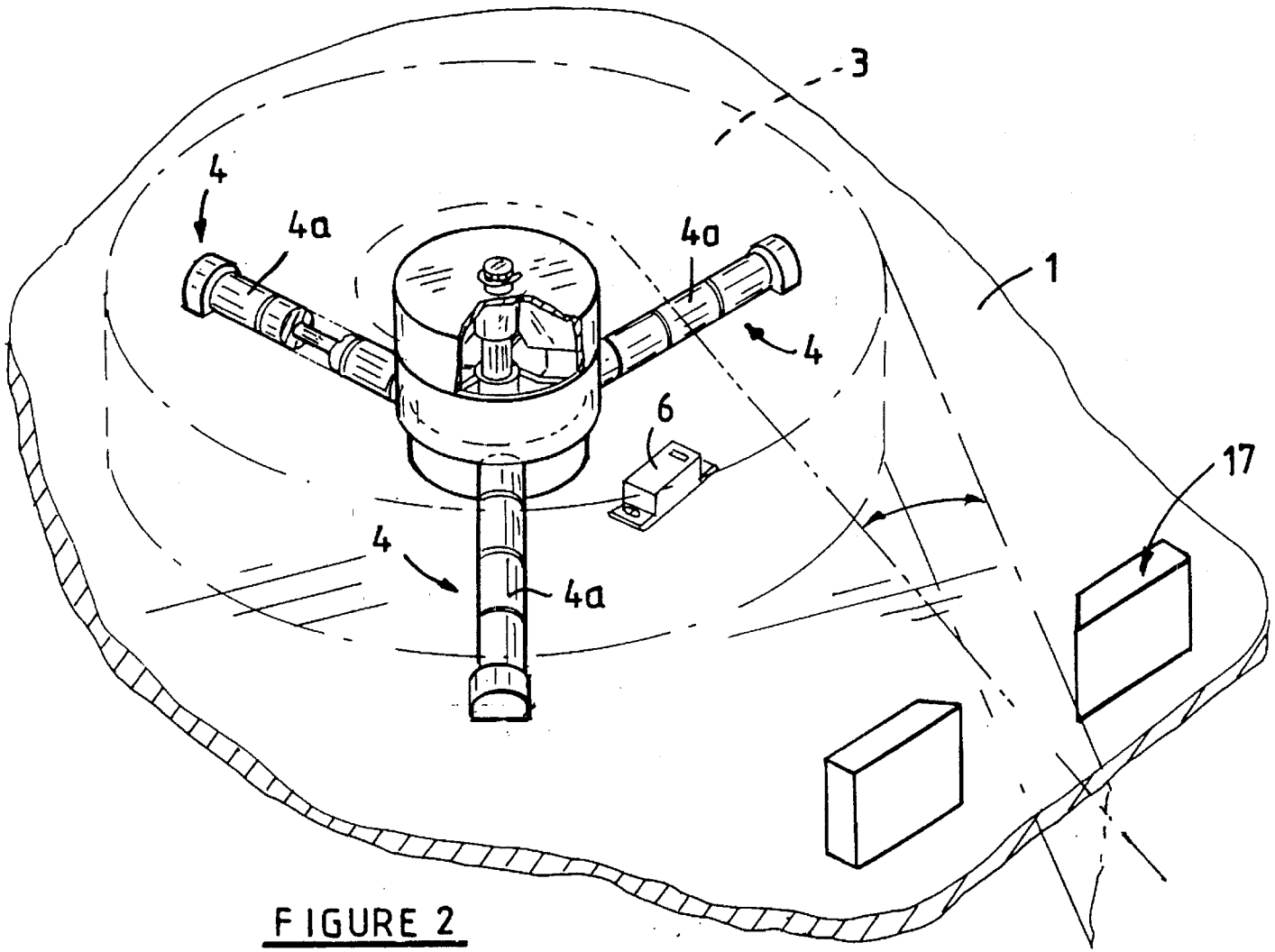
FIG. 2 is a schematic perspective view of a roll stock support assembly.
Figure 3:
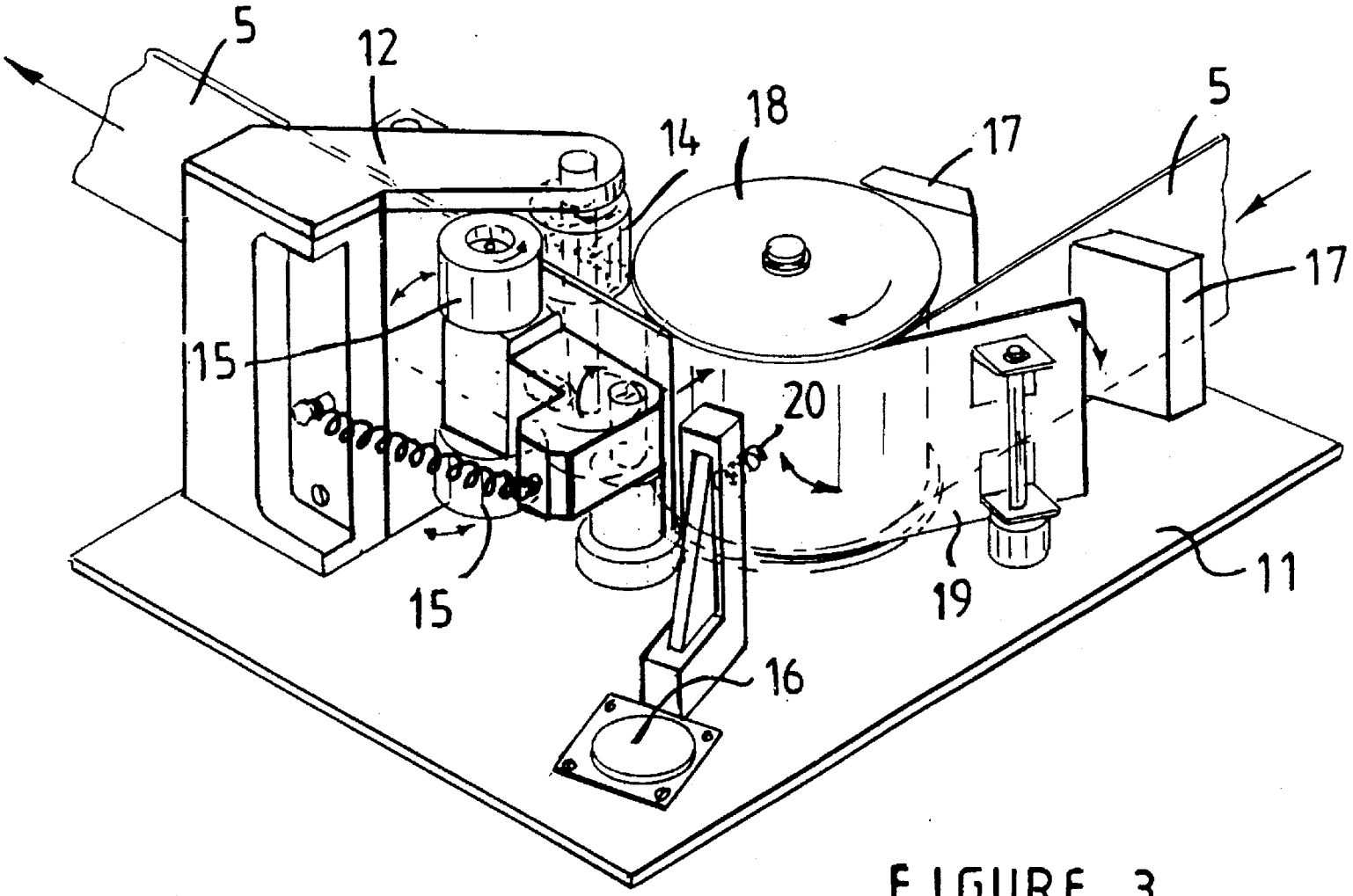
FIG. 3 is a schematic perspective view of a haul-off mechanism for strip material.
Figure 4:
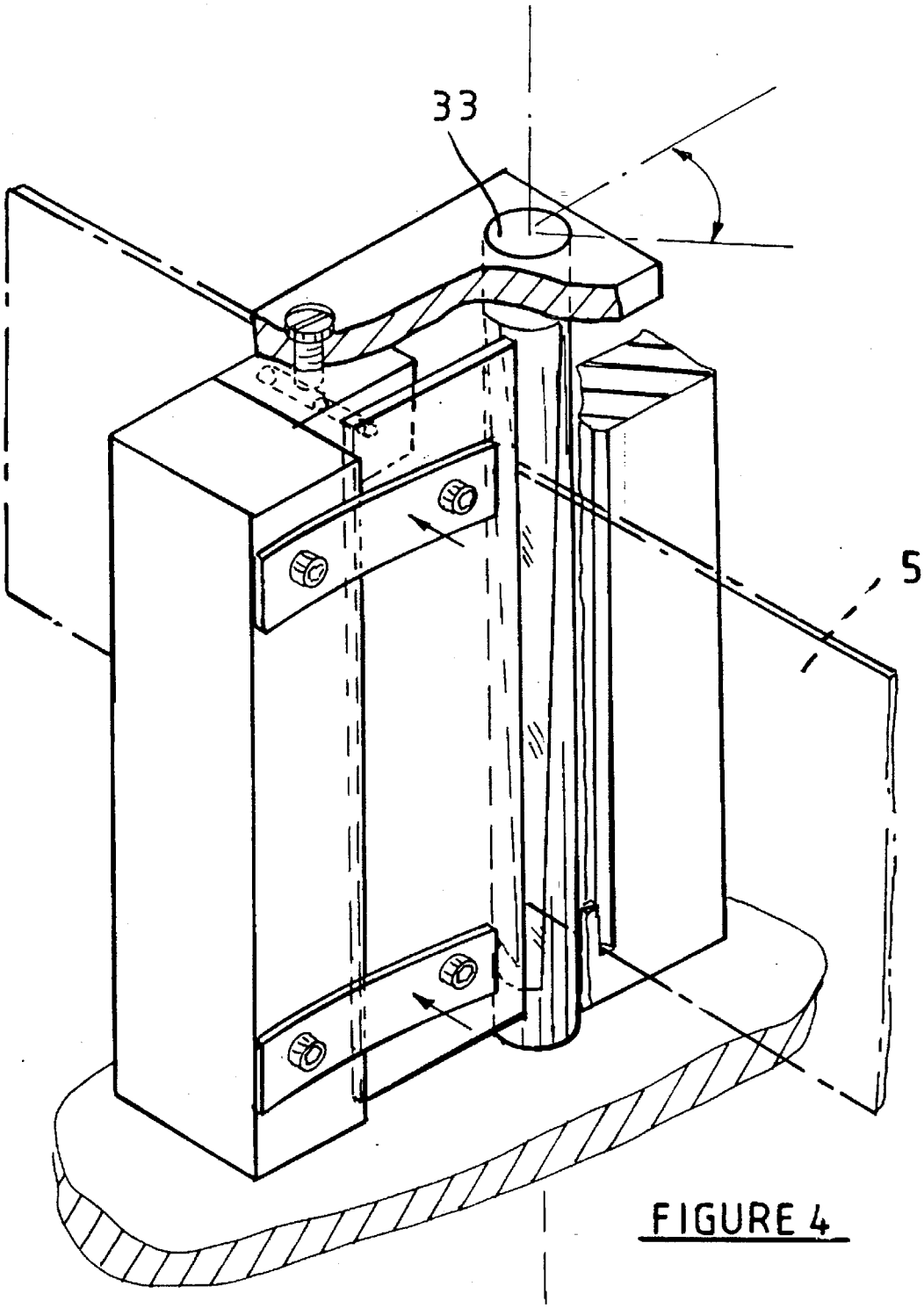
FIG. 4 is a schematic perspective view of a rotary-type guillotine.
Figure 5:
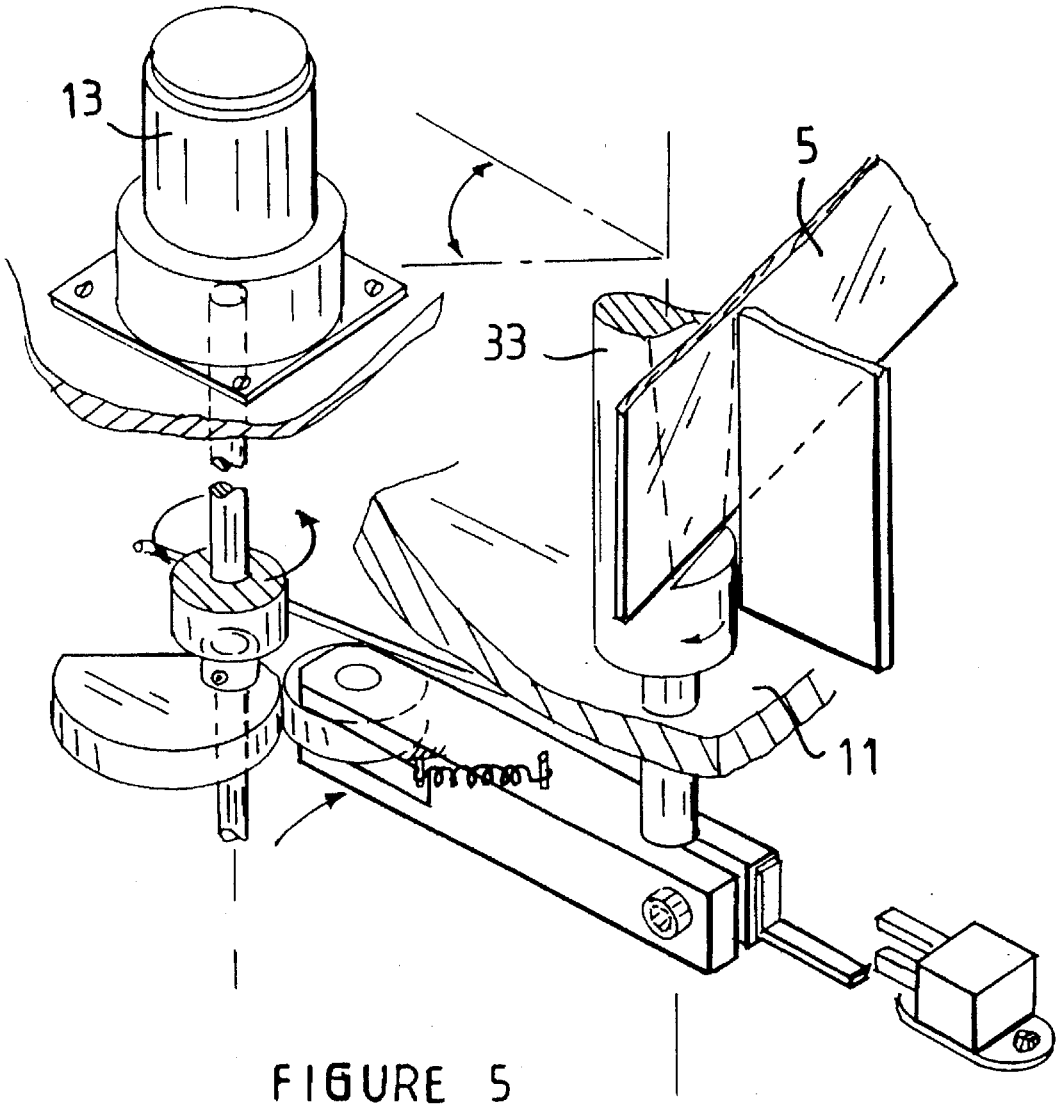
FIG. 5 is a schematic perspective view of a drive mechanism suitable for the guillotine in FIG. 4.
Figure 6:
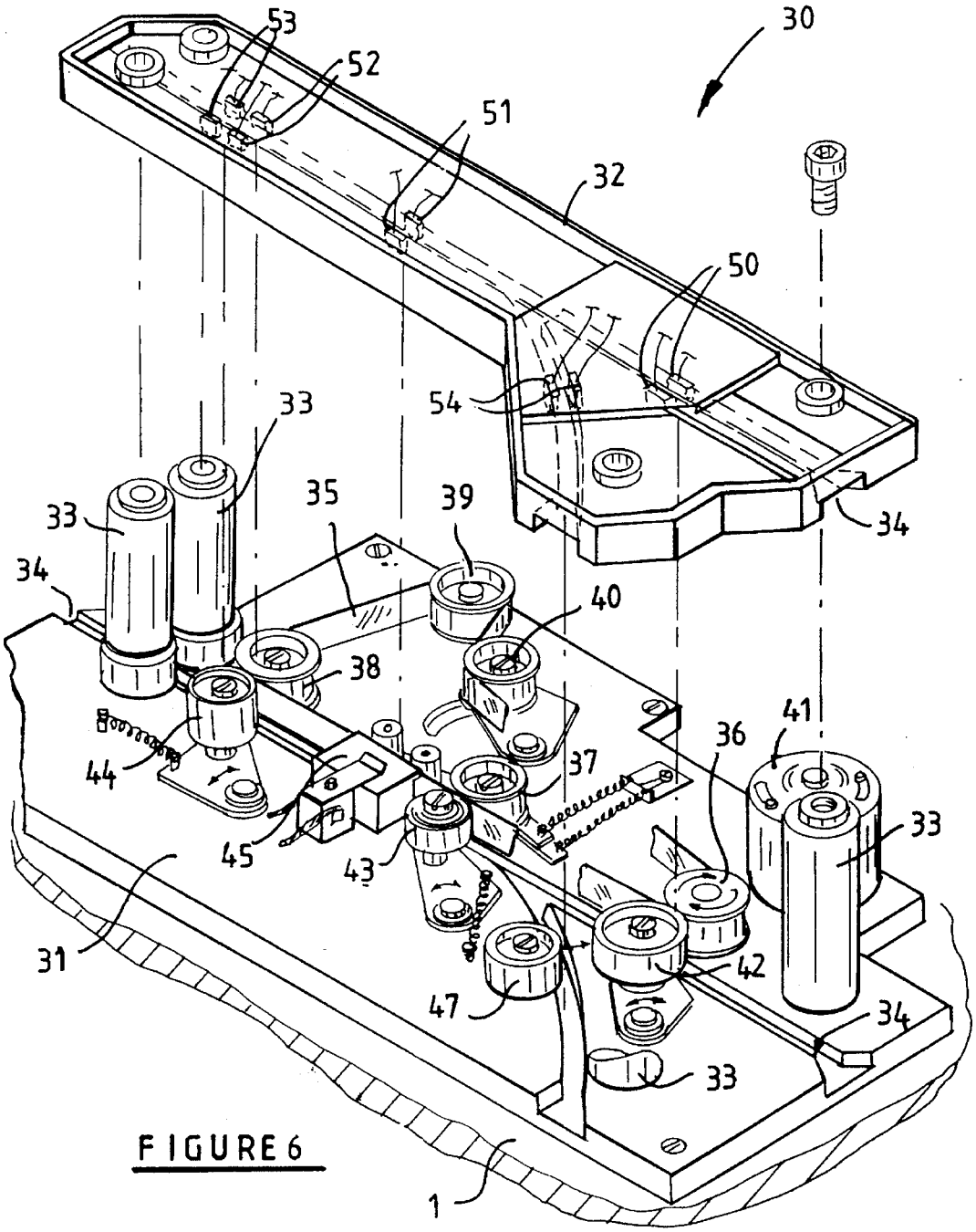
FIG. 6 is an exploded schematic perspective view of a ticket drive mechanism for moving a ticket past an encoder to a print head.
Figure 7:
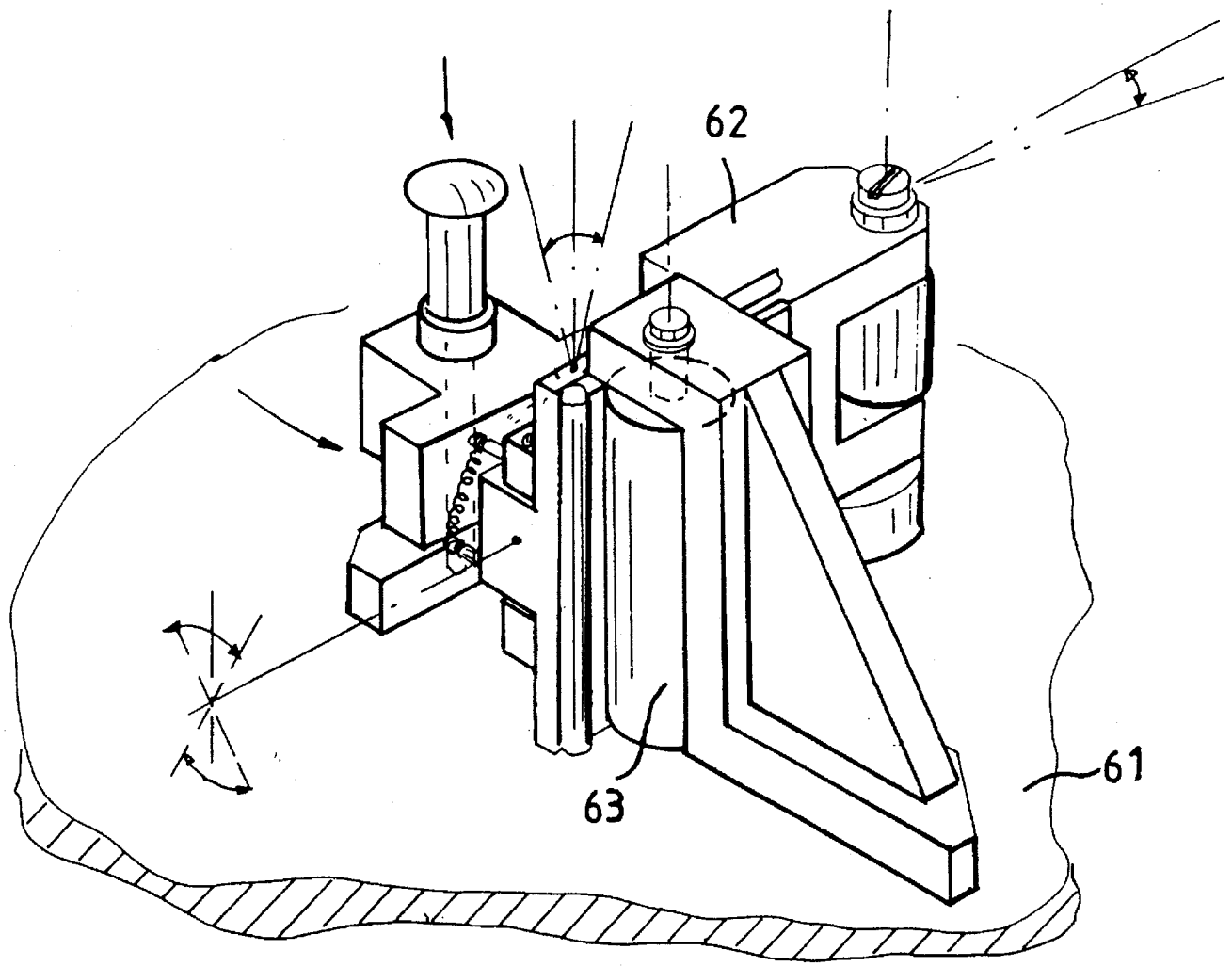
FIG. 7 is a schematic perspective view of a print head mounting assembly.
Figure 8:
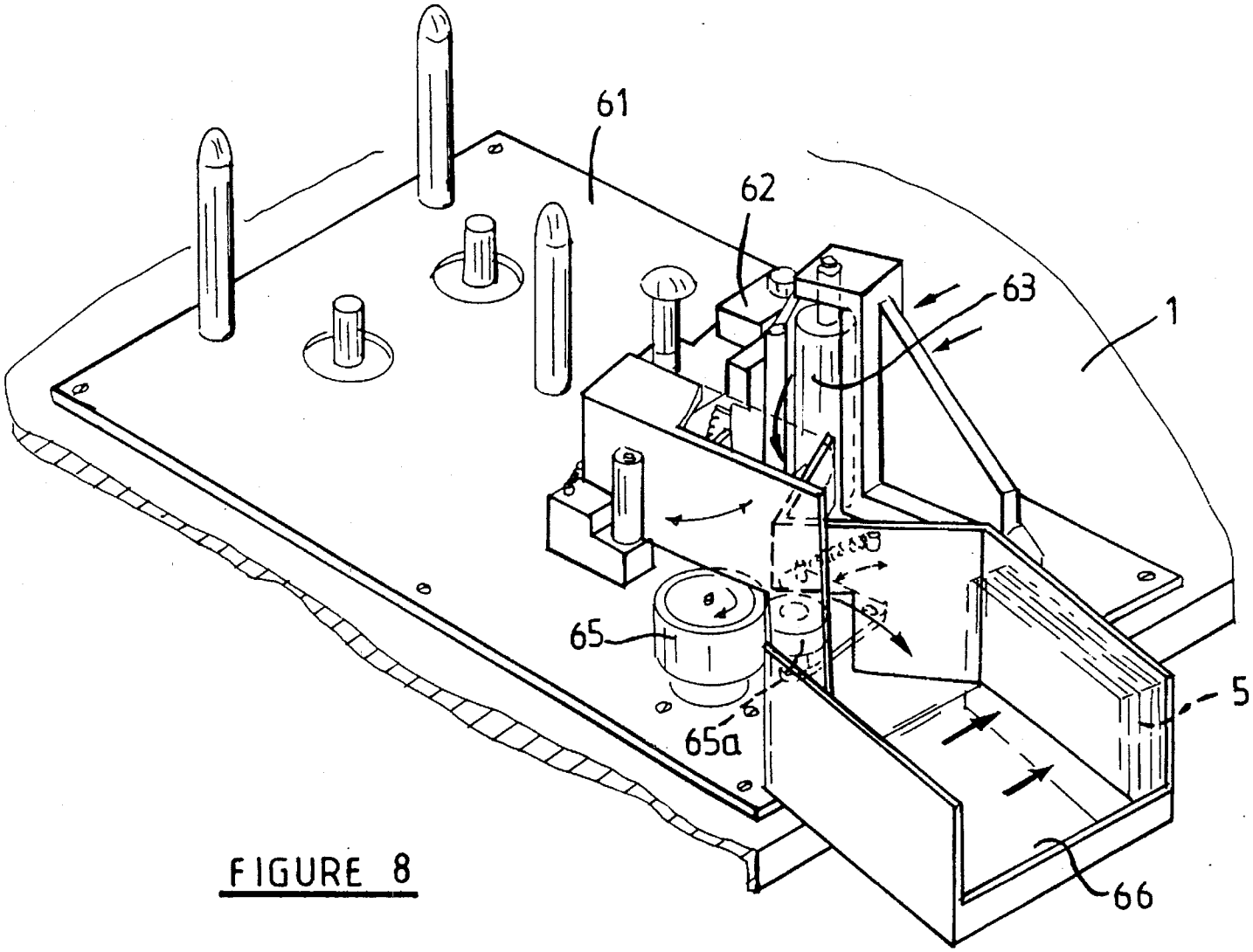
FIG. 8 is a schematic perspective view of a ticket ejector and stacking mechanism.

Referring to the drawings, a ticket issuing device comprises a box-like housing structure including a bed plate 1 constituting part of an upper housing section 2 connected by means of hinges **2*a*** to a lower housing section (not shown).

The ticket issuing machine incorporates a computer-controlled electronic circuit (not shown) housed within the lower housing section for operation, according to a predetermined sequence, of ticket processing modules mounted on bed plate 1.

The ticket issuing device operates using ticket roll stock web material 3 supported for rotation about the axis of the roll 3 on arms 4 which include tubular segments **4*a* rotatable about the axes of the arms. The continuous web 5 extends from the roll 3 to a guillotine module 10 incorporating a base plate 11 with guillotine roll stock haul-off and web guide components mounted thereon. The guillotine 12 is equipped with a drive motor 13 while the roll stock haul-off means, constituted by driven roller 14 and passive roller 15, has a motor 16 connected to the driven roller by means of a toothed belt (not shown) located beneath bed plate 1**.

The web 5 passes between the two sides of a sensor 17 over passive guide roller 18 equipped with a pivoted web guide 19 lightly pressed against the web 5 or guide roller 18 by means of compression spring 20.

The web 5 carries a longitudinally extending magnetic strip and is fed by the haul-off rollers 14, 15 to a magnetic encoder module 30. In order to monitor the quantity of available roll stock, a sensor 6 is provided beneath the roll 3 and this sensor provides a continuous reading of the reservoir of available ticket web material, The sensor 17 detects the end of the available ticket web material and operates to switch off the ticket issuing device on detection of the end of the web.

The magnetic encoder module 30 incorporates a base plate 31 on which upper and lower carrier plates 32, spaced apart by means of support posts 33, are mounted. The carrier plates 32 have inwardly facing vertically opposed longitudinal primary grooves 34 together defining a primary guide track for the web 5. The spacing of the plates 32 is such that the web is received edge-wise therebetween with its longitudinal edges trapped in grooves 34.

The magnetic ticket encoder module 30 also incorporates a ticket drive belt 35 which extends around pulleys 36 to 40, the pulley 36 being driven by a motor located beneath the bed plate 1 while pulleys 37–40 are passive. Pulley 40 is pivotally mounted on a suitable pivot plate (not shown) so that it may be located in a belt tensioning position.

Idler pinch rollers 42, 43 and 44 are mounted on suitable pivot plates (not shown) biased towards engagement with pulleys 36, 37 and 38 respectively so that the web 5 is pinched between the respective pulley and pinch roller pairs.

A magnetic encoder 45 is located on the lower carrier plate 32 adjacent the primary track 34 and the web 5, moving in the track, sweeps past the encoder 45 with its magnetic stripe suitably positioned against the encoder for appropriate storage of information magnetically on the stripe.

The carrier plates 32 also have inwardly facing vertically opposed secondary grooves 46 in the nature of tributaries for the primary grooves. Together they define a secondary guide track 46 linking with the primary track 34 prior to the location of encoder 45 on the primary track. An external ticket inserted into the secondary guide track 46 is pinched between a driven roller 47 and idler pinch roller 42 which can be pivoted by solenoid 41 into engagement with either pulley 36 or the driven roller 47 depending upon the need either to advance the web 5 in primary track 34 or the external ticket in secondary track 46. The ticket encoder and drive module 30 also includes sensors 50 to 54 which detect the position of a ticket in the guide tracks 34 and 46.

A ticket emanating from the magnetic encoder module 30 passes to a printer module 60 comprising components mounted on a base plate 61, These components include a printer 62 operating in conjunction with a drive platen roller 63 and a print ribbon cassette 64. A ticket ejector 65 is provided for ejecting encoded and printed tickets onto a stacking tray 66.

The ticket processing sequence of the ticket issuing device is as follows.

The first sensor 50 in the primary track senses the leading edge of the web 5 as it is advanced by operation of the roll stock haul-off means 14, 15 and operates to halt the roll stock feed drive mechanism. This sensor 50 is adjustable to provide a desired length of potential ticket between the leading edge of the web and the guillotine 12 positioned on the web path prior to the entrance to the primary track 34. Upon receiving a demand for the printing of a ticket from a keyboard module (not shown) forming part of the computer facility associated with the ticket issuing device, the guillotine 12 is initiated causing the web 5 to be severed providing an unprinted ticket length between sensor 50 and the guillotine 12. Thereafter the belt drive pulley 36 is initiated causing the ticket to advance along primary track 34 to sensor 51 which senses the leading edge of the ticket and initiates the magnetic encoder 45. As the ticket passes the magnetic encoder the appropriate data is magnetically stored in its magnetic stripe and this data is immediately proof-read by the encoder 60 so that a faulty encoding sequence will initiate an order to reject the ticket.

The belt drive 35 proceeds to advance the ticket until sensor 52 detects the trailing edge of the ticket and initiates the print drive platen roller 63. This initiating process also starts the roll stock haul-off drive roller 14, after a suitable pause which is software derived, so that the web 5 once again advances to the sensor 50 before the roll stock feed is terminated.

As the ticket passes sensor 53 its trailing edge is detected, the printing device is initiated and the belt drive pulley 36 is stopped. After completion of the thermal print process the exiting ticket is lodged between the ticket ejector roller 65 and its pinch roller 65A. A short pulse of current, again software derived, is applied to the ejector roller motor (not shown). This serves to eject the ticket onto the stacking tray 66.

The device is then ready to receive a further ticket demand signal from the keyboard module.

Should it be desired to process an external ticket, the latter may be inserted into the secondary track 46 where it is detected by sensor 54. This sensor produces a signal which actuates the solenoid 41 causing pinch roller 42 to swing into engagement with drive roller 47 thereby moving the external ticket into the primary track instead of a ticket obtained from the roll stock as described above.

A removable cover (not shown) is provided for the upper housing section 2, Such cover provides an external ticket feed aperture in the front face of the ticket issuing device and also covers the ticket ejector 65 leaving only a processed ticket exit aperture to tray 66.

I claim:

1. A ticket issuing device comprising:

ticket roll stock support means for supporting a roll of ticket stock;

a guillotine station for severing a ticket from the ticket stock;

a path for the ticket stock to move from the roll past the guillotine station;

a magnetic ticket encoder station for receiving a severed ticket from the guillotine station and storing data on the ticket;

a ticket printer station for receiving the ticket having snored data thereon and for printing the ticket;

and computer electronic control ticket processing means for controlling the operation of the guillotine, encoder and printer stations, wherein:

the stations each comprise a separate module composed of construction elements mounted on a corresponding base plate member;

the guillotine module comprises guillotine means for severing a ticket from the ticket stock, and roll stock haul-off means including a guide roller and pinch drive roller for advancing the ticket stock to the guillotine means, and a motor for the operation of each of the guillotine means and the drive roller;

the magnetic ticket encoder module includes magnetic encoder means for storing data on a magnetic stripe on the ticket stock, belt ticket drive means moving a ticket along a primary track past the encoder means, and sensor means linked to the electronic control means for controlling the ticket processing operation thereof by transmission of ticket processing signals to the control means;

wherein the primary track connects the guillotine, encoder and printer stations and wherein the sensor means comprises a series of sensors spaced along the primary track for detecting the position of a ticket during its movement along the track, the sensors transmitting ticket processing signals in accordance with a sequence based on the position of the ticket;

the belt ticket drive means causes the ticket to advance along the primary track to a first sensor of the sensor means which senses the leading edge of the ticket and initiates the operation of the magnetic encoder; and the belt ticket drive means advances the ticket beyond the magnetic encoder means to a second sensor of the sensor means for detecting the ticket, and there is provided in the ticket printer station a print drive platen roller initiated by the second sensor.

2. The device according to claim 1, wherein the magnetic ticket encoder module further includes a secondary track, linked to the primary track, for receipt of an external ticket to be moved into the primary track, the encoder module including drive means for movement of such external ticket along the secondary track and a sensor for detecting the location of an external ticket in the secondary track and for transmitting an external ticket processing signal.

3. The device according to claim 1, wherein the printer module comprises a printer and drive platen roller means for advancing an encoded ticket to the printer, support members for a print ribbon cassette for the printer, ticket ejector roller means for ejecting encoded and printed tickets, and a motor for driving each of the drive platen and ticket ejector roller means.

4. The device according to claim 1, including haul-off means in the guillotine module for advancing a severed ticket to the encoder module, and wherein the sensor means comprises a first sensor for detecting a leading edge of the ticket and a second sensor for detecting a trailing edge of the ticket.

5. The device of claim 1, including means for operating the guillotine means to sever the ticket stock and provide a separate ticket on receipt of a ticket demand signal from the control means, and for activating the belt ticket drive means following the operation of the guillotine means. leading edge of the ticket and initiates the operation of the magnetic encoder.

6. The device according to claim 1, wherein the magnetic encoder means comprises means for magnetically storing appropriate data on a magnetic stripe on the ticket and means for proofreading such data.

7. The device according to claim 6, wherein the encoder means provides a signal to reject a ticket when the proof-reading step detects faulty encoded data.

8. The device according to claim 1, wherein upon initiation of the print drive platen roller, the roll stock haul-off means is also activated so that the leading edge of the ticket stock is again advanced to the first sensor which stops the roll stock feed.

9. The device according to claim 1, wherein once the print drive platen roller is initiated, the operation of a printer of the ticket printing station is initiated and the belt drive means is stopped.

10. The device according to claim 9, including a ticket ejector roller and a pinch roller for receiving a printed ticket from the printer and ejecting the printed ticket onto a stacking tray.

11. The device according to claim 1, wherein the encoder module further comprises a secondary track for receiving an external ticket inserted therein and guiding the external ticket into the primary track, a sensor for detecting the external ticket inserted into the secondary track and producing a signal, and a drive roller activated by the signal for moving the external ticket into the primary track.

12. The device according to claim 11, further including a solenoid activated by the signal from the sensor, a drive roller adjacent the secondary track and a pinch roller moveable by the solenoid so as to swing into engagement with the drive roller to move the external ticket into the primary track.

* * * * *

UNITED STATES PATENT AND TRADEMARK OFFICE

CERTIFICATE OF CORRECTION

PATENT NO. : 5,482,391
DATED : January 9, 1996
INVENTOR(S) : John C. Cook

It is certified that error appears in the above-indentified patent and that said Letters Patent is hereby corrected as shown below:

Claim 1, column 5, line 44, change "snored" to --stored--; and

Claim 5, column 6, lines 40-42, delete "leading edge of the ticket and initiates the operation of the magnetic encoder.

Signed and Sealed this
Ninth Day of July, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,482,391

DATED : January 9, 1996

INVENTOR(S) : John C. Cook

It is certified that error appears in the above-indentified patent and that said Letters Patent is hereby corrected as shown below:

On the title page, item [73] Assignee: delete "The Republic of South Africa" should read -- Telkor (Proprietary) Limited--

Signed and Sealed this

Twentieth Day of August, 1996

*Attest:*

BRUCE LEHMAN

*Attesting Officer*

*Commissioner of Patents and Trademarks*